United States Patent [19]

Clapper et al.

[11] 4,411,061

[45] Oct. 25, 1983

[54] METHOD OF MAKING A THERMAL SWITCH HAVING A LEAD INTERLOCKED THERETO BY A SKIVED PART OF THE LEAD

[75] Inventors: Allen R. Clapper; Burlin Davis, both of Laurel County, Ky.

[73] Assignee: Emerson Electric Co., St. Louis, Mo.

[21] Appl. No.: 422,598

[22] Filed: Sep. 24, 1982

Related U.S. Application Data

[63] Continuation of Ser. No. 277,647, Jun. 26, 1981, abandoned.

[51] Int. Cl.[3] ..... H01H 69/00

[52] U.S. Cl. ..... 29/622; 29/460; 29/469.5; 29/509; 337/407

[58] Field of Search ..... 29/509, 622; 337/401, 337/402, 407–409, 413–415

[56] References Cited

U.S. PATENT DOCUMENTS

| | | | |
|---|---|---|---|
| 3,091,838 | 6/1963 | Hild et al. | 29/522 |
| 3,180,958 | 4/1965 | Merrill | 200/142 |
| 3,392,253 | 7/1968 | Adams et al. | 29/522 |
| 3,778,879 | 12/1973 | Ottolander | 174/117 F |
| 4,060,787 | 11/1977 | Budnick | 337/408 |
| 4,145,654 | 3/1979 | Grimm | 337/407 |

FOREIGN PATENT DOCUMENTS

| | | | |
|---|---|---|---|
| 54-5743 | 1/1979 | Japan | 337/407 |

*Primary Examiner*—William H. Beha, Jr.
*Attorney, Agent, or Firm*—Candor, Candor & Tassone

[57] ABSTRACT

A thermal switch having a lead interlocked to an end plug thereof by a part skived from the lead and compacted against an end of the end plug.

5 Claims, 11 Drawing Figures

FIG. 5"

METHOD OF MAKING A THERMAL SWITCH HAVING A LEAD INTERLOCKED THERETO BY A SKIVED PART OF THE LEAD

CROSS REFERENCE TO RELATED APPLICATION

This application is a continuation patent application of its copending parent patent application, Ser. No. 277,647 filed June 26, 1981, and now abandoned in favor of this continuation application.

BACKGROUND OF THE INVENTION

1. Field of the Invention

This invention relates to an improved thermally actuatable electrical switch construction and to a sub-assembly therefor as well as methods and apparatus of making the same.

2. Prior Art Statement

It is known to provide a thermally actuatable electrical switch construction having a housing means carrying an electrically insulating end plug provided with an opening passing therethrough and in which a portion of a conductive lead is disposed so that opposed ends of the lead extend beyond opposed ends of the end plug and respectively define a fixed contact means inside the housing means and a terminal means outside the housing means. The lead has means interlocking with the end plug to prevent axial movement of the lead into the housing means. The means of the lead interlocking with the end plug comprises an integral part of the terminal means extending outboard of the opening and disposed against the respective opposed end of the end plug that is adjacent the terminal means whereby the lead and the part thereof comprise a one-piece member.

For example see FIGS. 8 and 9 of the U.S. Pat. No. 3,180,958 to Merrill, wherein the lead 118 is crimped at 119 and FIGS. 3, 4 and 5 of the Japanese Pat. No. 54-5743 wherein in FIG. 3 it appears that the lead 2 is crimped at 13, in FIG. 4 it appears that the lead 2 is split at 14 to provide abutments 15, and in FIG. 5 it appears that the lead 2 is lanced at 16 to provide opposed tabs 17.

Another prior known means for interlocking the lead to the end plug forms the portion of the lead that is disposed in the opening of the end plug with a plurality of radially disposed reliefs in a manner to prevent each relief from extending around the circumference of the lead so as to cause the sealing compound means to enter the reliefs and form set blocks of subsequently hardened sealing means that tend to prevent axial movement of the lead into the housing means as well as to tend to prevent rotational movement of the lead relative to the end plug. For example, see U.S. Pat. No. 4,060,787 to Budnik.

SUMMARY OF THE INVENTION

It is one feature of this invention to provide an improved thermally actuatable electrical switch construction wherein the conductive lead that is carried in an opening means of an insulating end plug is interlocked to the end plug to tend to prevent axial movement of the lead into the housing means that carries the end plug.

In particular, it has been found to be advantageous to interlock the conductive lead of a thermally actuatable electrical switch construction in the opening means of the electrically insulating end plug carrying the same with the epoxy resin that flows by capillary action or other means into the opening means around the lead as the epoxy resin is being disposed on an exterial end portion of the conductive housing or casing, the projecting portion of the end plug and a terminal portion of the lead extending out of the end plug to hermetically seal the lead to the casing and thereby prevent air from entering the casing through or around the insulating end plug.

For example, see aforementioned patent to Budnik, U.S. Pat. No. 4,060,787, for a teaching of some of the reasons for so interlocking the conductive lead with the sealing compound in the opening means of the thermally actuatable electrical switch construction as well as for a teaching of a method of so forming a lead for thereafter interlocking the same, the U.S. patent to Budnik being incorporated into this disclosure by this reference thereto.

However, it is believed according to the teachings of this invention that the conductive lead of a thermally actuatable electrical switch construction can be formed in another unique manner to interlock with the end plug in a manner to be effective in preventing axial movement of the lead in the opening means of the end plug in a direction that would be into the housing means that carries that end plug.

In particular, it is believed according to the teachings of this invention that an integral part of the lead can be formed so as to extend outboard of the end plug and be disposed against the respective end of the end plug whereby the lead and the part thereof comprise a one-piece member and will prevent that lead from being moved relative to the end plug in a direction thereof that would be into the casing or housing means that carries such end plug.

For example, one embodiment of this invention provides a thermally actuatable electrical switch construction having a housing means carrying an electrically insulating end plug provided with an opening means passing therethrough and in which a portion of a conductive lead is disposed so that opposed ends of the lead extend beyond opposed ends of the end plug and respectively define a fixed contact means inside the housing means and a terminal means outside the housing means, the lead having means interlocking with the end plug to tend to prevent axial movement of the lead into the housing means. The means of the lead interlocking with the end plug comprises an integral part of the terminal means extending outboard of the opening and disposed against the respective opposed end of the end plug that is adjacent the terminal means whereby the lead and the part thereof comprise a one-piece member. The part of the lead comprises a skiving of the lead.

It is another feature of this invention to provide an improved sub-assembly for such a thermally actuatable electrical switch construction, the sub-assembly of this invention comprising an electrically insulating end plug and a conductive lead carried thereby with the lead having means interlocking with the end plug to tend to prevent axial movement of the lead relative to the end plug.

For example, another embodiment of this invention provides a sub-assembly of a conductive lead and an electrically insulating end plug for a thermally actuatable electrical switch construction having a housing means adapted to carry the electrically insulating end plug, the end plug having an opening means passing therethrough and in which a portion of the conductive lead is disposed so that opposed ends of the lead extend beyond opposed ends of the end plug and respectively define a fixed contact means adapted to be disposed inside the housing means and a terminal means adapted to be disposed outside the housing means. The fixed contact means is disposed against one of the opposed ends of the end plug, the lead having means interlocking with the other of the opposed ends of the end plug to tend to prevent axial movement of the lead relative to the end plug. The means of the lead interlocking with the end plug comprises an integral part of the terminal means extending outboard of the opening and disposed against the other opposed end of the end plug whereby the lead and the part thereof comprise a one-piece member. The part of the lead comprises a skiving of the lead.

It is another feature of this invention to provide an apparatus for making such a sub-assembly.

Accordingly, it is an object of this invention to provide an improved thermally actuatable electrical switch construction having one or more of the novel features of this invention as set forth above or hereinafter shown or described.

Another object of this invention is to provide a method of making such a thermally actuatable electrical switch construction, the method of this invention having one or more of the novel features of this invention as set forth above or hereinafter shown or described.

Another object of this invention is to provide an improved sub-assembly of an electrically insulating end plug and a conductive lead for a thermally actuatable electrical switch construction, the sub-assembly of this invention having one or more of the novel features of this invention as set forth above or hereinafter shown or described.

Another object of this invention is to provide a method of making such a sub-assembly, the method of this invention having one or more of the novel features of this invention as set forth above or hereinafter shown or described.

Another object of this invention is to provide an apparatus for making such a sub-assembly, the apparatus of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 5' and FIG. 5'' are enlarged fragmentary views similar to FIG. 5 and illustrate the method and apparatus of FIG. 5 in various stages of the operation thereof.

DESCRIPTION OF THE PREFERRED EMBODIMENTS

Figure 1:
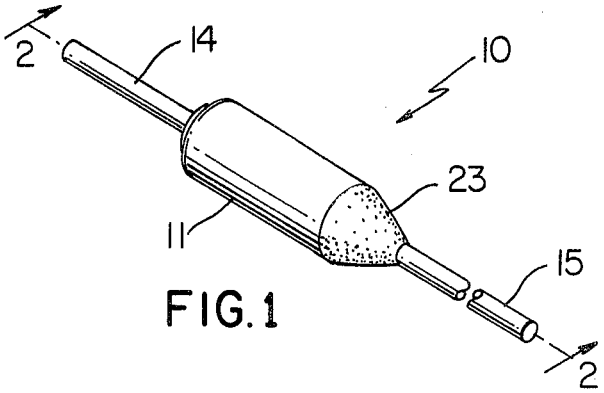
FIG. 1 is a perspective view of the improved thermally actuatable electrical switch construction of this invention.

While the various features of this invention are hereinafter described and illustrated as being particularly adapted to provide a thermally actuatable electrical switch construction, it is to be understood that the various features of this invention can be utilized singly or in any combination thereof to provide other types of electrical switch constructions as desired.

Therefore, this invention is not to be limited to only the embodiments illustrated in the drawings, because the drawings are merely utilized to illustrate one of the wide variety of uses of this invention.

Figure 2:
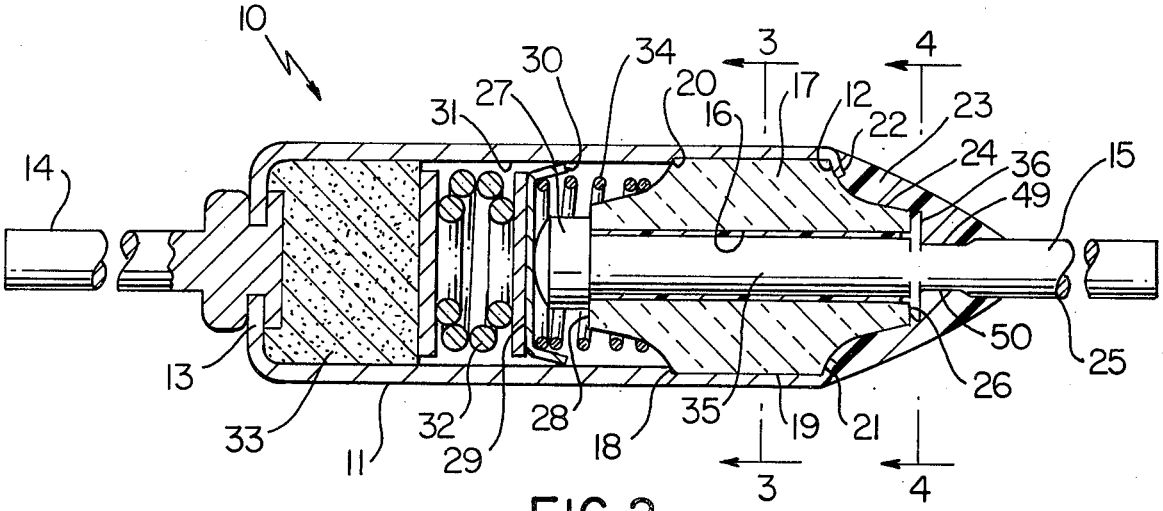
FIG. 2 is an enlarged cross-sectional view of the thermally actuatable electrical switch construction of FIG. 1 and is taken substantially on the line 2—2 of FIG. 1.

Referring now to FIGS. 1 and 2, the improved thermally actuatable electrical switch construction of this invention is generally indicated by the reference numeral 10 and is substantially of the same type and construction as the thermally actuatable electrical switch construction disclosed and claimed in the U.S. Pat. No. 3,519,972 to Merrill, and such U.S. patent to Merrill is being incorporated into this disclosure by this reference thereto for setting forth the details of the structure and operation of the thermally actuatable electrical switch construction 10 of this invention. Therefore, it is only necessary to describe certain details of the thermally actuatable electrical switch construction 10 to understand the feature of this invention.

In particular, the thermally actuatable electrical switch construction 10 includes an electrically conductive casing or housing means 11 formed of metallic material and having an open end 12 and a closed end 13 secured to an electrically conductive lead or terminal 14 while another electrically conductive lead 15 is carried in an opening means 16 of an electrically insulating end plug 17 secured in the open end 12 of the casing or housing means 11 by having one end 18 of a cylindrical portion 19 thereof abutting a shoulder 20 of the casing 11 and the other end 21 being held by a turned over end 22 of the casing 11 whereby the end plug 17 is fixed in the open end 12 of the casing 11 and is hermetically sealed thereto by a suitable epoxy resin 23 being disposed on the exterior of the casing 11 at the turned end 22 thereof and over a projecting cone portion 24 of the end plug 17 and onto a terminal means or end 25 of the lead 15 that projects beyond the adjacent end 26 of the end plug 17 as illustrated whereby the uncovered part of the end 25 of the lead 15 provides a terminal structure for the thermally actuatable electrical switch construction 10 to be interconnected into the desired electrical circuit.

The lead 15 has an enlarged arresting head 27 that projects beyond the end 28 of the end plug 17 and bears against the same outboard of the opening means 16 to define a fixed contact means within the casing 11 that is normally engaged by a movable disc-like contact member 29 that has outer peripheral resilient fingers 30 disposed in sliding and electrical contact with the internal peripheral surface 31 of the casing 11 as illustrated, the movable contact 29 normally being held in conductive contact with the fixed contact 27 by a compression spring 32 normally held in the compressed condition illustrated in FIG. 1 by a temperature sensitive member 33 that remains in the solid condition illustrated in FIG. 2 as long as the same is sensing a temperature below a predetermined temperature. However, when the temperature sensed by the member 33 exceeds the predetermined temperature thereof, the member 33 melts and thereby permits the compression spring 32 to expand so that a normally weaker compression spring 34 disposed between the end plug 17 and the movable contact member 29 can expand and move the movable contact 29 out of contact with the fixed contact 27.

Therefore, it can be seen that as long as the temperature sensing member 33 is in the solid condition illustrated in FIG. 2, an electrical circuit can be completed between the terminals 14 and 25. However, once the temperature sensitive member 33 melts, the force of the compression spring 34 now moves the movable contact 29 out of contact with the fixed contact 27 and holds the same out of contact with the fixed contact 27 so that the electrical circuit between the terminals 14 and 25 is permanently interrupted by the thermally actuated electrical switch construction 10.

As set forth in the aforementioned U.S. Pat. No. 4,060,787, to Budnik, it is desired to prevent someone from attempting to push axially inwardly on the lead 15, after the thermally actuatable switch construction 10 has been thermally actuated in the manner previously described, and break the bond between the epoxy resin 23 and the lead 15 so as to move the lead 15 into the casing 11 to again contact the fixed contact 27 against the movable contact 29. This could be accomplished by the person pushing inwardly on the lead 15 with sufficient force to break the bond between the epoxy resin 23 that has seeped into the bore or opening means 16 around the inner portion 35 of the lead 15 or by that person first tending to rotate the lead 15 relative to the end plug 17 and thereby breaking such bond so as to thereafter push axially inwardly on the lead 15.

As previously stated, it is a feature of this invention to provide unique interlocking means between the lead 15 of this invention and the end plug 17 to tend to prevent such axial inward movement of the lead 15 into the casing or housing means 11.

In particular, it was found according to the teachings of this invention that an integral part of the lead 15 can be formed by the method and apparatus of this invention to interlock the lead 15 with the end plug 17.

This improved interlocking means of this invention comprises an integral part 36 of the lead 15 that is formed so as to be disposed outboard of the opening 16 and against the end 26 of the end plug 17 so as to tend to prevent movement of the lead 15 into the housing 11 of the thermally actuatable electrical switch construction 10.

Figure 5:
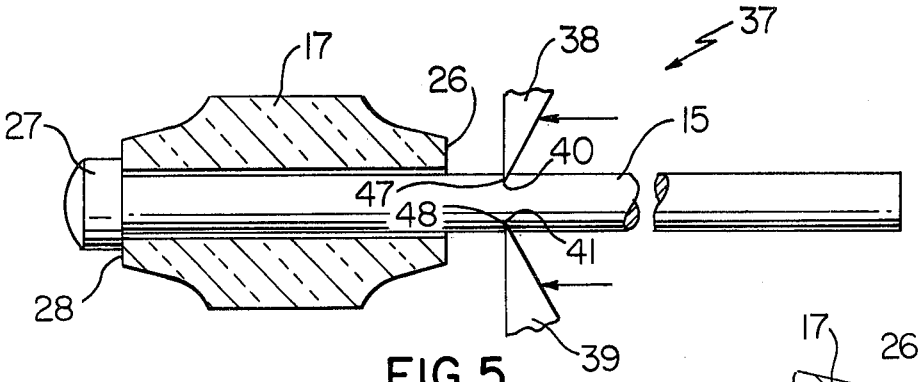
FIG. 5 is an axial cross-sectional view schematically illustrating one method and apparatus of this invention for forming a sub-assembly of this invention that is utilized in forming the thermally actuatable electrical switch construction of this invention that is illustrated in FIGS. 1-4.
Figure 5:
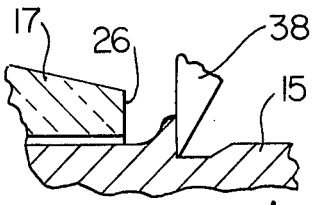
Figure 8:
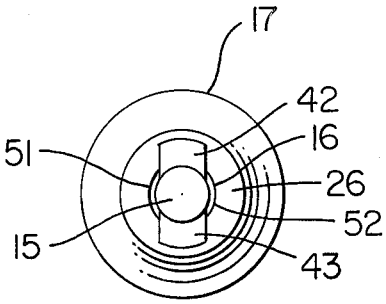
FIG. 8 is an end view of the sub-assembly of FIG. 6 and is taken in the direction of the arrows 8—8 of FIG. 6.

One embodiment of the method and apparatus of this invention for forming the part 36 of the lead 15 is generally indicated by the reference numeral 37 in FIG. 5 and comprises a pair of opposed skiving knives 38 and 39 which are adapted to be brought toward each other to indent slightly into the opposed sides of the lead 15 after the lead 15 has been disposed in the opening 16 of the end plug 17 with its enlarged fixed contact means 27 disposed against the end 28 of the end plug 17. The skiving knives 38 and 39 initially engage into the lead 15 at the respective points 40 and 41 thereon which are spaced from the end 26 of the end plug 17 a distance sufficient to subsequently form the part 36 from the resulting skived or shaved material of the lead 15 when the skiving knives 38 and 39 in the in position are subsequently moved toward the end plug 17 while the lead 15 is held in the position illustrated in FIG. 5 so that the skived material being skived or shaved from the opposed sides of the lead 15 as illustrated in FIGS. 5' and 5'' will respectively be compacted and reshaped against the end 26 of the end plug 26 to form two tab-like portions 42 and 43 respectively disposed against the end 26 of the end plug 17 as illustrated in FIG. 6 and respectively extending radially outwardly from the opposed sides of the lead 15 as illustrated in FIG. 8.

As the skived material 42 and 43 is being formed and reshaped against the end 26 of the end plug 17 by the skiving knives 38 and 39 moving to the left in FIG. 5 to the position illustrated in FIG. 6, portions 44 and 45 of the skived material 42 and 43 adjacent the skived material 42 and 43 actually enter into the opening 16 of the end plug 17 to not only cause centering of the lead 15 in the opening 16 of the end plug 17 for a purpose hereinafter described, but also to provide means for interlocking with the epoxy resin 23 as will be apparent hereinafter.

Figure 6:
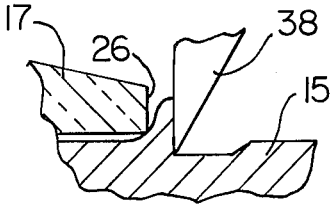
FIG. 6 is a view similar to FIG. 5 and illustrates the completed sub-assembly that was made by the method and apparatus of FIG. 5 or FIG. 7.
Figure 6:
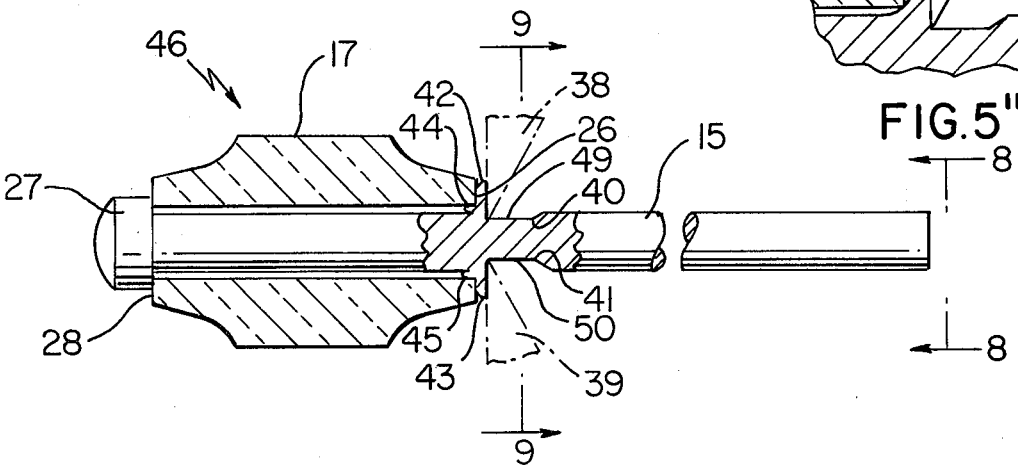

Thus, it can be seen that the method and apparatus 37 illustrated in FIG. 5 is adapted to provide a self-contained sub-assembly in FIG. 6 that comprises the lead 15 and the end plug 17 and is generally indicated by the reference numeral 46 in FIG. 6, the end plug being sandwiched between the contact means 27 of the lead 15 and the part 36 of the lead 15.

Figure 3:
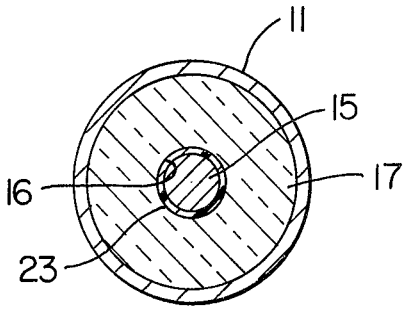
FIG. 3 is a cross-sectional view taken on line 3—3 of FIG. 2.
Figure 4:
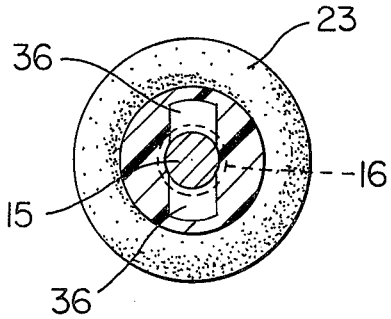
FIG. 4 is a cross-sectional view taken on line 4—4 of FIG. 2.
Figure 9:
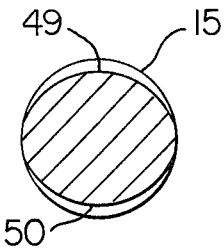
FIG. 9 is an enlarged cross-sectional view taken on line 9—9 of FIG. 6.

The skiving knives 38 and 39 respectively have the skiving surfaces 47 and 48 thereof formed in such a unique manner that the same skive the lead 15 to provide opposed recesses 49 and 50 on the terminal portion 25 of the lead which do not join with each other as they only extend around the circumference of the substantially cylindrical lead 15 at a distance that is less than 180° as fully illustrated in FIG. 9. This feature permits the skived material 42 and 43 that is disposed outboard of the opening 16 and against the end 26 of the end plug 17 to not cover substantial portions of the opening 16 as represented by the reference numerals 51 and 52 in FIG. 8. In this manner, the portions 51 and 52 of the opening 16 readily permit the epoxy resin or sealing compound 23 to flow into the opening 16 by capillary action to completely surround the portion 35 of the lead 15 in the manner illustrated in FIGS. 2 and 3 to seal the opening 16 as well as to interlock with the portions 44 and 45 of the skived material 42 and 43 to tend to prevent rotational movement between the lead 15 and the end plug 17, the portions 44 and 45 when formed having centered the portion 35 of the lead within the opening 16 to substantially insure that the epoxy resin 23 can flow completely around the portion 35 of the lead 15 in the opening 16.

In addition, when the sub-assembly 46 of this invention is disposed in the open end 12 of the casing 11 to form the thermally actuatable electrical switch construction 10 and have the epoxy resin 23 subsequently disposed on the end 24 of the end plug 17 as illustrated in FIG. 2, the skived portions 42 and 43 have been formed of a size that the epoxy resin 23 fully covers the skived portions 42 and 43 as illustrated in FIG. 2 and extends onto the lead 15 beyond the recesses 49 and 50 as illustrated in FIG. 2. In this manner, the shape of the recesses 49 and 50 as well as the configuration of the skived tab-like members 42 and 43 interlock with the epoxy material 23 when the same subsequently hardens to tend to prevent rotational movement between the lead 15 and the end plug 17.

Figure 7:
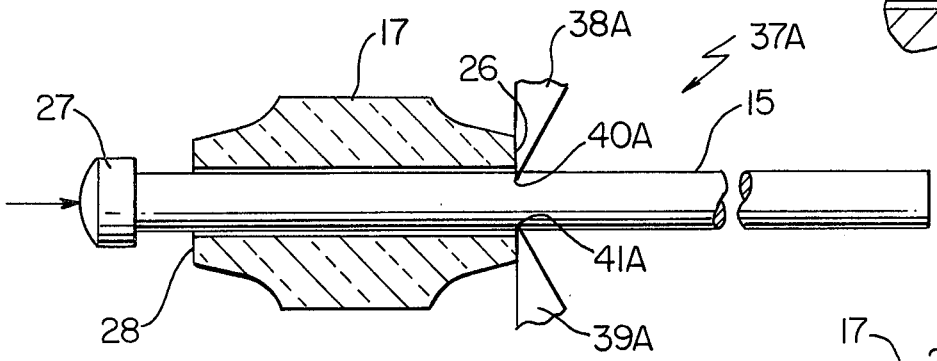
FIG. 7 is a view similar to FIG. 5 and illustrates another embodiment of the method and apparatus of this invention for forming the sub-assembly of FIG. 6.

The self-contained sub-assembly 46 of this invention can be made by another method and apparatus of this invention that is generally indicated by the reference numeral 37A in FIG. 7 and parts thereof similar to the method and apparatus 37 illustrated in FIG. 5 are indicated by like reference numerals followed by the reference letter "A".

As illustrated in FIG. 7, the apparatus 37A includes the skiving knives 38A and 39A adapted to respectively come together and initially dig into the lead 15 at the points 40A and 41A on the opposed sides of the lead 15 at a location spaced from the contact means 27 of the lead 15 which is exactly the same distance that the skiving knives 38 and 39 of the apparatus 37 initially make contact at the points 40 and 41 with the lead 15 of FIG. 5.

However, in the apparatus 37A of FIG. 7, it can be seen that the lead 15 is moved to the right in FIG. 17 while the skiving knives 38 and 39A are held stationary in their inwardly indented position so that subsequently the rightward moving lead 15 has the contact means 27 impacted against the end 28 of the end plug 17 so that the resulting skived material will be impacted and reshaped against the other end 26 of the end plug 17 when the apparatus 37A is in the position illustrated in FIG. 6 whereby the resulting self-contained sub-assembly 46 is identical to the self-contained sub-assembly 46 produced by the method and apparatus 37 of FIG. 5.

Therefore, it can be seen that it is a relatively simple method of this invention to form the integral part 36 of the lead 15 to interlock against the end 26 of the insulating end plug 17 to tend to prevent axial movement of the lead 15 relative to the end plug 17 in one direction while the contact means 27 prevents axial movement in the opposite direction.

Thereafter, it can be seen that it is a relatively simple method to assemble the sub-assembly 46 of this invention into a casing or housing means 11 to form the thermally actuatable electrical switch construction 10 of this invention because once the end plug 17 has been secured in place by turning over the end 12 of the casing 11 to hold the cylindrical part 19 of the end plug 17 between the shoulder 20 and the turned end 12 as illustrated in FIG. 2, the subsequent disposal of the epoxy resin 23 on the device 10 causes the epoxy resin 23 to enter by capillary action through the portions 51 and 52 of the opening 16 to completely surround the portion 35 of the lead 15 to seal the opening 16 as well as to interlock with the portions 44 and 45 of the skived parts 42 and 43 of the lead 15, the skived parts 42 and 43 and recesses 49 and 50 also interlocking with the epoxy resin 23 as illustrated to tend to prevent rotational movement between the lead 15 and the device 10.

While this invention is not to be limited to specific dimensions, one typical thermally actuatable electrical switch construction 10 made by the method and apparatus of this invention comprised a lead 15 of No. 18 AWG electrolytic tough pitch copper wire approximately 0.0403 of an inch in diameter and having a flash silver plating thereon of approximately 0.000020 of an inch thick. The longitudinal length of the skived recesses 49 and 50 therein were approximately 0.045 of an inch and approximately 0.003 of an inch deep at the point of greatest depth thereof. The length of the end plug 17 is approximately 0.057 of an inch and the diameter of the opening 16 therein is approximately 0.045 of an inch. It was found that the resulting self-contained sub-assembly 46 when assembled in the device 10 provided substantial resistance to inward axial movement of the lead 15 relative to the device 10 even after the epoxy resin material 23 had been completely melted off of the same. In addition, it was found that the recesses 49 and 50 in the lead 15 do not adversely reduce the strength of the lead 15 between such areas so as to cause breaking of the lead 15 between the recesses 49 and 50.

Also, it has been found that when tabs are merely lanced from the lead to interlock with the end of the end plug, such lanced tabs tend to merely fold back into place when the lead is heated and is axially pushed into the end plug whereas with the skived tabs, sufficient material from the lead has been plowed or shaved in advance of the skiving knives to cause a jamming with the end plug when the lead is heated and an axial force is imposed on the lead in a direction toward the end plug. In this manner, the skived tabs provide a greater resistance to an axial force tending to move the respective lead into the thermally actuatable electrical switch construction than is provided by the lanced tabs.

Therefore, it can be seen that this invention not only provides an improved thermally actuatable electrical switch construction and an improved self-contained sub-assembly therefor, but also this invention provides improved methods and apparatus for making such a thermally actuatable electrical switch construction and such a self-contained sub-assembly therefor.

While the forms and methods of this invention now preferred have been illustrated and described as required by the Patent Statute, it is to be understood that other forms and method steps can be utilized and still fall within the scope of the appended claims.

What is claimed is:

1. In a method of making a thermally actuatable electrical switch construction having a housing means carrying an electrically insulating end plug provided with an opening means passing therethrough and in which a portion of a conductive lead is disposed so that opposed ends of said lead extend beyond opposed ends of said end plug and respectively define a fixed contact means inside said housing means and a terminal means outside said housing means, said lead having means interlocking with said end plug to tend to prevent axial movement of said lead into said housing means, said means of said lead that interlocks with said end plug comprising an integral part of said terminal means that extends outboard of said opening and is disposed against the respective opposed end of said end plug that is adjacent said terminal means whereby said lead and said part thereof comprise a one-piece member, said switch construction having a sealing compound disposed on said respective end of said end plug so as to extend onto said terminal means outboard of said part thereof whereby said compound covers said part, said compound extending into said opening from said respective end of said end plug and surrounding said portion of said lead within said end plug, the improvement comprising the steps of skiving said part from said lead, and compacting said skived part against said respective opposed end of said end plug, said steps of skiving and compacting comprising the step of forming said part to comprise a plurality of circumferentially spaced apart tab-like members extending substantially radially from said terminal means against said respective opposed end of said end plug and respectively having portions disposed in said opening in said end plug in circumferentially spaced apart relation to tend to center said portion of said lead in said opening of said end plug and to interlock with said compound in said opening to tend to prevent rotational movement of said lead relative to said end plug.

2. A method of making a thermally actuatable electrical switch construction as set forth in claim 1 wherein said steps of skiving and compacting take place before said end plug and its interlocked lead are assembled with said housing means.

3. A method of making a thermally actuatable electrical switch construction as set forth in claim 1 wherein said terminal means has a generally circular transverse cross-section configuration and wherein said steps of skiving and compacting said part of said terminal means causes said part to comprise a pair of said tab-like members extending substantially radially from opposed sides of said terminal means.

4. A method of making a thermally actuatable electrical switch construction as set forth in claim 1 wherein said steps of skiving and compacting comprise the steps of indenting into said terminal means of said lead with skiving knife means in a direction substantially transverse to the longitudinal axis of said lead and at a plurality of point means each longitudinally spaced from said fixed contact means thereof and circumferentially spaced from each other, and thereafter, and while said knife means are in such indented position, causing relative movement between said lead and said knife means in a direction substantially parallel to said longitudinal axis of said lead to shave or plow said skived part from said terminal means from said point means toward said fixed contact means until said skived part is compacted against said respective opposed end of said end plug between said respective opposed end of said end plug and said skiving knife means, said steps of skiving and compacting comprising the step of creating a plurality of recesses in said terminal means each of which is many times longer in a longitudinal direction thereof than the transverse depth thereof at the point of the greatest depth of the respective recess.

5. A method of making a thermally actuatable electrical switch construction as set forth in claim 4 wherein said conductive lead has a diameter of approximately 0.0403 of an inch and wherein said step of creating said recesses creates each said recess to have a depth of approximately 0.003 of an inch at the point of greatest depth thereof and to have a longitudinal length of approximately 0.045 of an inch.

* * * * *